United States Patent [19]

Veitel et al.

[11] 4,036,577

[45] July 19, 1977

[54] CANDLE SNUGGER

[76] Inventors: Robert D. Veitel; Myrtle M. Veitel, both of 1333 Martha Washington Drive, Wauwatosa, Wis. 53213

[21] Appl. No.: 661,473

[22] Filed: Feb. 26, 1976

[51] Int. Cl.[2] ..... F23D 3/16; F23N 5/02

[52] U.S. Cl. ..... 431/35; 169/26; 431/145; 431/297

[58] Field of Search ..... 431/33, 35, 144, 145, 431/297, 289; 169/26

[56] References Cited

U.S. PATENT DOCUMENTS

| | | | |
|---|---|---|---|
| 701,557 | 6/1902 | Garrigan | 431/144 X |
| 1,647,898 | 11/1927 | Bearse | 431/297 |
| 3,486,563 | 12/1969 | Cholin et al. | 169/26 |
| 3,710,855 | 1/1973 | Ojorio | 169/26 |

FOREIGN PATENT DOCUMENTS

| | | | |
|---|---|---|---|
| 1,423,888 | 11/1965 | France | 431/35 |
| 14,797 | 12/1885 | United Kingdom | 431/297 |
| 19,974 | 9/1896 | United Kingdom | 431/297 |
| 30,086 | 12/1897 | United Kingdom | 431/35 |

*Primary Examiner*—Irwin C. Cohen

*Attorney, Agent, or Firm*—Wheeler, Morsell, House & Fuller

[57] ABSTRACT

A packing member for securing a candle in a candle holder is in the form of a thin disk of polyurethane foam which has a diameter larger than the diameter of the candle butt and which is concentrically located with respect to the candle holder opening during insertion of the candle and packing member in the candle to encapsulate the butt end of the candle and firmly grip the candle. The disk is treated with dry chemical fire extinguishing components so that when the flame burns proximate the disk, carbon dioxide or other extinguishing gases are released to snuff out the candle.

1 Claim, 4 Drawing Figures

CANDLE SNUGGER

SUMMARY OF INVENTION

The invention provides a packing member to firmly secure a candle in the sleeve or opening in the candle holder. The disk is preferably formed from a polyester, polyurethane, open-celled foam. A disk an eighth of an inch thick and one and three quarters inches in diameter is an appropriate size for the slim candles conventionally used in candelabras, etc. The foam disk is compressible, stretchable and deformable, and thus readily conforms to the shape of the candle butt and holder to firmly grip the candle. The open-celled foam also provides opposed friction surfaces to grip both the candle holder and the candle.

The disk is desirably treated with a dry chemical fire extinguishing composition to snuff out the candle when the candle burns down to the butt end.

Further objects, features and advantages of the invention will become apparent from the following disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
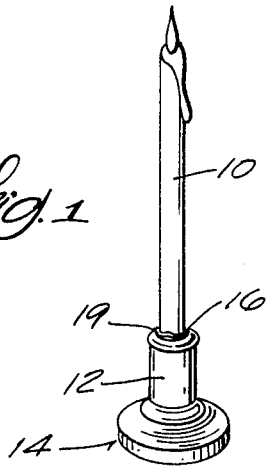
FIG. 1 is a perspective view of a candle holder including the packing member of the invention.
Figure 2:
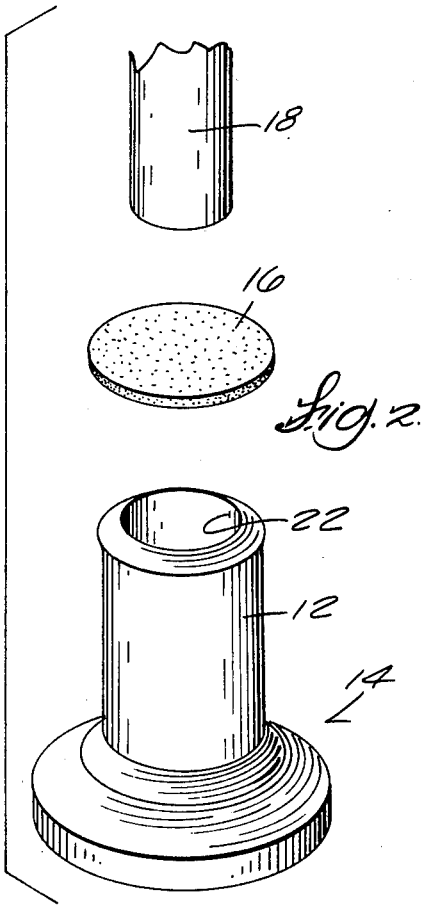
FIG. 2 is an enlarged perspective view showing the packing member, a candle butt and a candle holder.
Figure 3:
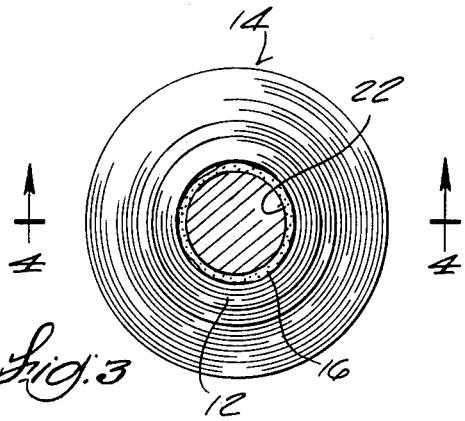
FIG. 3 is an enlarged plan view of FIG. 1.

FIG. 1 shows a candle 10 inserted in the sleeve 12 of a candle holder 14. The packing member 16 of the invention encapsulates the butt end 18 of the candle 10.

The upper margin 19 of the member 16 may protrude from the candle holder 14 as shown in FIG. 1.

The packing member 16 is in the shape of a disk cut from polyester, polyurethane, open-celled foam. Disks 3/32 to ⅛ inch in thickness have been found suitable to provide the desired bulk to fill the gap between the candle butt and the opening in the candle holder. If necessary, more than one disk can be employed.

Figure 4:
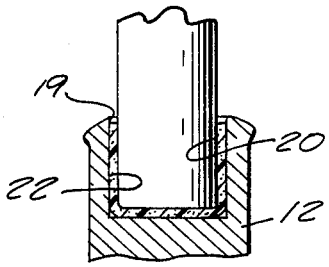
FIG. 4 is a sectional view along line 4—4 of FIG. 3.

The packing member or disk 16 also is desirably larger in diameter than the butt 18 of the candle so that the disk 16 forms a pocket 20, as shown in FIG. 4 encapsulating the butt 18 of the candle 10 when the candle and disk are inserted in the opening 22 in the candle holder.

When assembling the candle and disk in the holder 14, the disk 16 is concentrically located with respect to the opening 22 to provide a fairly uniform amount of disk material around the candle.

The disk is desirably treated with a dry chemical fire extinguishing composition such as sodium bicarbonate, potassium bicarbonate or an ammonium phosphate to extinguish the flame when the candle burns proximate the upper margin 19 of the packing member 16.

We claim:

1. In combination a candle with a candle butt and a candle holder with an opening, a compressible and yieldable circular disk of polyurethane foam having opposed friction surfaces and a diameter greater than the diameter of the butt of the candle, said disk being adapted to be concentrically positioned with respect to the holder opening and to form a pocket around the candle occupying the space between the candle and the candle holder opening to encapsulate the butt of the candle and secure the candle in the holder said disk being sized with respect to the diameter of the candle so that the disk has an upper margin arranged around the periphery of the candle adjacent the top of the candle holder and wherein the disk is treated with a heat activated composition which gasifies when exposed to the candle flame to snuff out the candle as the candle burns proximate said disk.

* * * * *